US009558658B2

(12) United States Patent
Stenneth

(10) Patent No.: US 9,558,658 B2
(45) Date of Patent: Jan. 31, 2017

(54) METHOD FOR TRANSFORMING PROBE DATA ACROSS TRANSPORTATION MODES

(71) Applicant: HERE Global B.V., Veldhoven (NL)

(72) Inventor: Leon Stenneth, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 0 days.

(21) Appl. No.: 14/039,393

(22) Filed: Sep. 27, 2013

(65) Prior Publication Data

US 2015/0094940 A1 Apr. 2, 2015

(51) Int. Cl.
*G08G 1/01* (2006.01)

(52) U.S. Cl.
CPC ..... *G08G 1/0125* (2013.01); *G08G 1/0112* (2013.01); *G08G 1/0129* (2013.01); *G08G 1/0141* (2013.01)

(58) Field of Classification Search
CPC .. G08G 1/0112; G08G 1/0125; G08G 1/0129; G08G 1/0141
USPC ..... 701/117
See application file for complete search history.

(56) References Cited

U.S. PATENT DOCUMENTS

| | | | | |
|---|---|---|---|---|
| 6,317,686 | B1 * | 11/2001 | Ran | 701/533 |
| 8,452,529 | B2 * | 5/2013 | Alten | 701/400 |
| 2005/0151963 | A1 | 7/2005 | Pulla et al. | 356/139.03 |
| 2008/0082251 | A1 * | 4/2008 | Ishikawa et al. | 701/118 |
| 2009/0216704 | A1 * | 8/2009 | Zheng et al. | 706/52 |
| 2012/0173530 | A1 * | 7/2012 | Kurciska et al. | 707/738 |
| 2013/0166204 | A1 * | 6/2013 | Davies et al. | G01C 21/34 701/533 |
| 2014/0244125 | A1 * | 8/2014 | Dorum et al. | 701/70 |
| 2014/0342701 | A1 * | 11/2014 | Tateishi et al. | 455/411 |
| 2015/0046087 | A1 * | 2/2015 | Nogawa | 701/522 |

FOREIGN PATENT DOCUMENTS

| | | | |
|---|---|---|---|
| EP | 0 838 663 | A2 | 4/1998 |
| EP | 1 742 188 | A2 | 1/2007 |
| EP | 1 870 869 | A2 | 12/2007 |
| EP | 2 177 928 | A1 | 4/2010 |
| JP | 2004037301 | A * | 2/2004 |
| JP | 2006344037 | A * | 12/2006 |
| JP | 2013140498 | A * | 7/2013 |
| WO | WO 2013/098988 | A1 * | 7/2013 |

OTHER PUBLICATIONS

Bae, Sanghoon, "Dynamic Estimation of Travel Time on Arterial Roads by Using Automatic Vehicle Location (AVL) Bus as Vehicle Probe", Ph.D Thesis, Virginia Tech, 1995, 314 pages.*

(Continued)

*Primary Examiner* — Behrang Badii
*Assistant Examiner* — David Testardi
(74) *Attorney, Agent, or Firm* — Alston & Bird LLP

(57) ABSTRACT

Disclosed herein is a method. A relationship between a first probe type and a second different probe type is determined. The first probe type includes one of a deficient probe or an abundant probe. The second different probe type includes the other of the deficient probe or the abundant probe. A time estimate based on data corresponding to the deficient probe and/or the abundant probe is provided. Abundant probe information is converted to deficient probe information based on the time estimate.

20 Claims, 12 Drawing Sheets

(56) References Cited

OTHER PUBLICATIONS

Chakroborty, Partha et al., "Using bus travel time data to estimate travel times on urban corridors", Transportation Research Record: Journal of the Transportation Research Board, No. 1870, 2004, pp. 18-25.*

Elesawey, Mohamed, "Travel Time Estimation in Urban Areas Using Neighbor Links Data", Ph.D Thesis, University of British Columbia, Oct. 2010, 177 pages.*

Kothuri, Sirisha M. et al., "Arterial Travel Time Estimation Using Transit Vehicles and Bluetooth MAC Readers", ITE Western District, Alaska 2011 Technical Paper Compendium, 2011, 13 pages.*

Pu, Wenjing, "Bus probe based urban travel time prediction", Ph.D Thesis, University of Illinois at Chicago, 2008, 185 pages.*

Pu, Wenjing et al., "Real-time estimation of urban street segment travel time using buses as speed probes" Transportation Research Record: Journal of the Transportation Research Board, No. 2129, 2009, pp. 81-89.*

Sringiwai, K. et al., "RFID-Based Time Estimation: Development Case in Bangkok", 2010, 8 pages, downloaded from http://bal.buu.ac.th/bal2010/sites/default/files/Report/rfid_travel_time.pdf.*

Wikipedia article, "Motor vehicle", Old revision dated Sep. 15, 2013, 8 pages.*

Pu Thesis Uic Library Catalogue Record (Staff View), "Bus probe based urban travel time prediction", 1 page , 2008, downloaded from: http://vufind.carli.illinois.edu/vf-uic/Record/uic_2147731/Details.*

* cited by examiner

METHOD FOR TRANSFORMING PROBE DATA ACROSS TRANSPORTATION MODES

TECHNICAL FIELD

The invention relates to probe data and, more particularly, to probe data corresponding to a traffic information system.

BACKGROUND

Often time, travel time, traffic flow, and travel speed information is available for freeways and expressways. These can be derived from probe vehicles such as cars traversing these roads that reports information such as location changes, speed, and so forth. However, urban smaller streets are usually void or imprecise in terms of real time travel information such as travel time or traffic flow, generally owing to probes that usually provide location and travel information are mainly on major roadways such as expressways and freeways, whereas, on smaller urban/city streets, regular probes generally do not exist or do not provide adequate coverage. Therefore versatile components and/or features are needed in order to take full advantage of capabilities of traffic information.

SUMMARY

Various aspects of examples of the invention are set out in the claims.

In accordance with one aspect of the invention, a method is disclosed. A relationship between a first probe type and a second different probe type is determined. The first probe type includes one of a deficient probe or an abundant probe. The second different probe type includes the other of the deficient probe or the abundant probe. A time estimate based on data corresponding to the deficient probe and/or the abundant probe is provided. Abundant probe information is converted to deficient probe information based on the time estimate.

In accordance with another aspect of the invention, an apparatus is disclosed. The apparatus includes at least one processor and at least one memory. The at least one memory includes computer program code. The at least one memory and the computer program code configured to, with the at least one processor, cause the apparatus to perform at least the following. Receive a first information corresponding to a first transportation mode. Transform the first information into a second information based on a analysis of the first information. The second information corresponds to a second different transportation mode.

In accordance with another aspect of the invention, a computer program product is disclosed. The computer program product includes a computer-readable medium bearing computer program code embodied therein for use with a computer. The computer program code includes code for determining a relationship between a first information and a second information. The first information corresponds to a first transportation mode. The second information corresponds to a second different transportation mode. Code for transforming the first information into a second information based on a analysis of the first information.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

Example embodiments of the present invention and its potential advantages are understood by referring to FIGS. 1 through 17 of the drawings.

Figure 1:
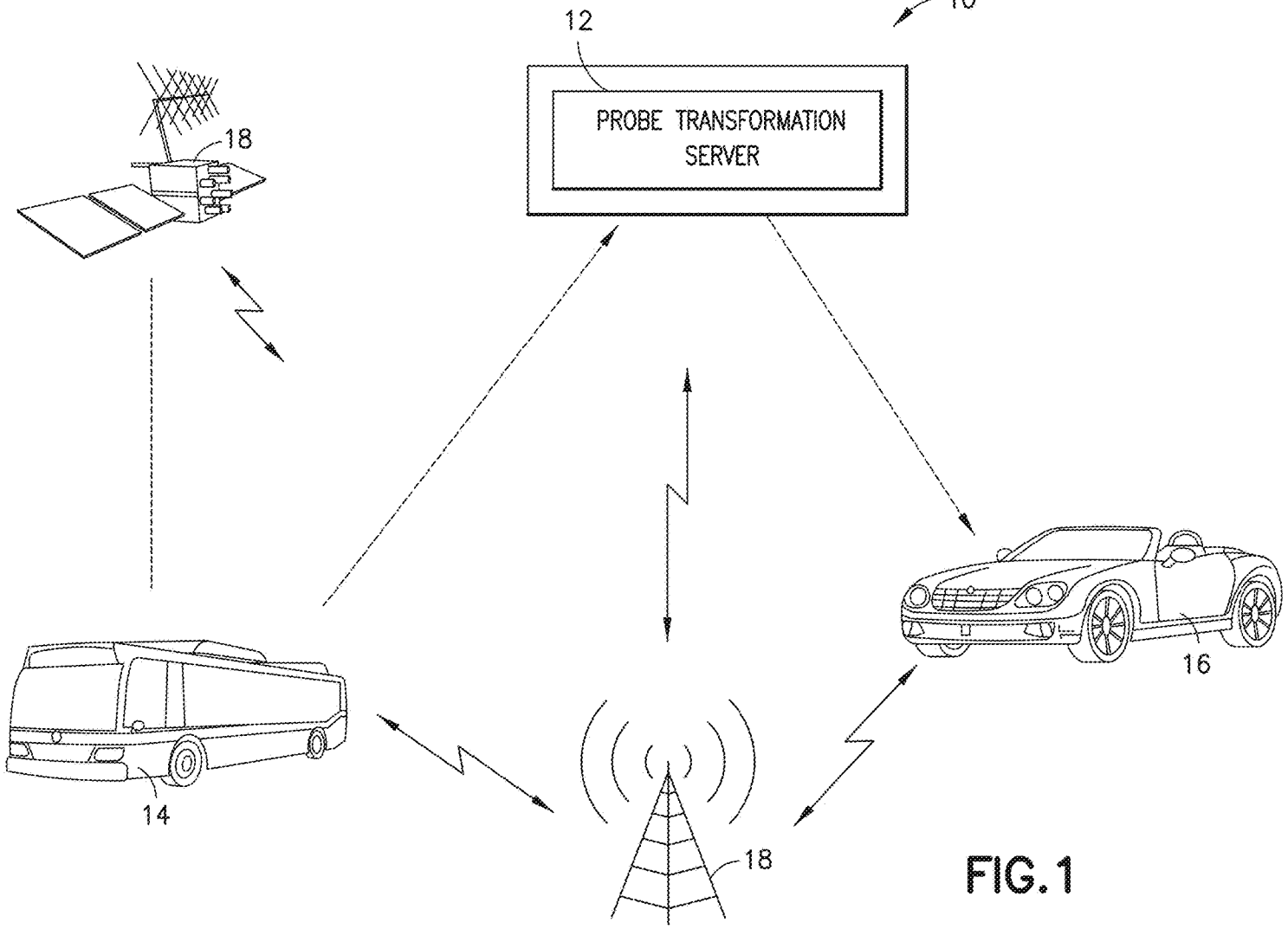
FIG. 1 illustrates a traffic information system and probe transformation model incorporating features of the invention.

Referring to FIG. 1, there is shown a traffic information system 10 including a probe transformation server 12 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The traffic information system 10 generally provides for the collection of data relating to traffic and road conditions, the analysis and organization of this collected data, the formatting of the analyzed data into traffic messages, and the transmission of these traffic messages to the vehicles 14, 16 on a regular and continuing basis.

According to various exemplary embodiments, probe vehicles, such as vehicles 14, 16 can be used to collect traffic data along roads. A probe vehicle generally refers to a vehicle that is used for collecting traffic data while being driven on roads for other purposes unrelated to traffic data collection. For example, a probe vehicle may be a vehicle owned by a private individual who uses the vehicle for commuting to work or for leisure activities. Probe vehicles may also include vehicles that are part of a fleet of commercial vehicles, such as delivery trucks that are used to deliver packages. Probe vehicle may also include vehicles used for public transportation, such as buses and taxis.

To use a vehicle as a probe vehicle for traffic data collection, equipment is installed in the vehicle that collects data that indicates the vehicle's location and speed. This equipment in the probe vehicle may operate automatically while the vehicle is being driven. Then, as the vehicle is being used for purposes unrelated to traffic data collection, information about the vehicle's current location and speed is automatically transmitted to the traffic information system 10 (which may include a central data facility, for example). The traffic information system 10 is generally configured to analyze and aggregate the data with data from other probe vehicles. In some embodiments of the invention, the probe transformation server 12 may be part of the central data facility of the traffic information system 10. However, any suitable configuration may be provided.

The traffic information system 10 may include any suitable equipment and programming for collecting the data relating to traffic conditions from the vehicles that are equipped as probes. This equipment and programming may include, for example, various communications links (including wireless links), receivers, data storage devices, programming that saves the collected data, programming that logs data collection times and locations, and so on. The traffic information system may use various means in addition to probe vehicles to obtain information about traffic and road conditions.

The traffic information system may include equipment and programming for assembling, organizing, analyzing and formatting the collected traffic and road condition data. This programming and equipment may include storage devices, programming that statistically analyzes the collected data for potential errors, programming that organizes the collected data, and programming that uses the data to prepare messages in one or more appropriate predetermined formats.

The traffic information system may also include suitable equipment and programming for transmitting or broadcasting the data messages. The equipment and programming may include interfaces to transmitters, programming that communicates formatted messages at regular intervals to the transmitters, and so on. The traffic information system may also include transmission equipment 18. This equipment may include one or more satellites, FM transmitters, including antennas, towers, other wireless transmitters, or any other suitable wireless link. This equipment provides for broadcasting or transmitting the formatted traffic and road condition data messages throughout a region. However, it should be noted that, in some embodiments, the transmission equipment 18 maybe part of other systems, such as cellular or paging systems, satellites, FM radio stations, and so on, to transmit traffic data messages to the vehicles 14, 16.

Additionally, according to some embodiments of the invention some of the vehicles 14, 16 include suitable equipment that enables them to receive the traffic data transmitted by the traffic information system 10. There are various types of traffic information systems and traffic message formats. For example, in some embodiments the traffic information system 10 may conform to the RDS-TMC system, where the messages conform to the ALERT-C format. However, in alternate embodiments, any suitable type of system or message format may be used and/or provided.

According to various exemplary embodiments of the invention, the probe transformation server 12 can transform bus probe information to car probe information. For example, buses travel at different speeds and adhere to bus stops and other passenger requirements. Thus, once the probe information of one transportation mode is obtained, the probe transformation server can automatically convert the bus probe information into any other transportation mode. Transportation modes may include for example, train, car, bus, walk, run, bike, and so forth.

Travel time estimation and travel speed estimation for non-transit vehicles on expressways and highways can generally be produced based on probe information from probe vehicles that traverse these major roadways. However, probe information from probe vehicles is not always available for smaller urban/city streets, as there may not be any (or an insufficient amount) of probe vehicles on these streets. Thus conventional configurations generally may not provide adequate speed and travel time estimates for the smaller urban/city streets. According to various exemplary embodiments of the invention, the probe transformation server allows for bus probe information, from mass transit buses, for example, to be transformed to car probes. Thus, bus probes can then be used to provide high order speed and time estimates for non-transit vehicles such as cars, trucks, trains, and so forth. Preprocessing of the bus probes for transformation to other probes such as cars may take into consideration the location of bus stops and bus only lanes. In one implementation during bus probe transformation to car probe transformation the location of bus stops and bus only lanes are archived on the server. Bus probes submitted at these points (such as, bus stops and bus only lanes, for example) can be handled differently (for example, they can be suppressed).

Figure 2:
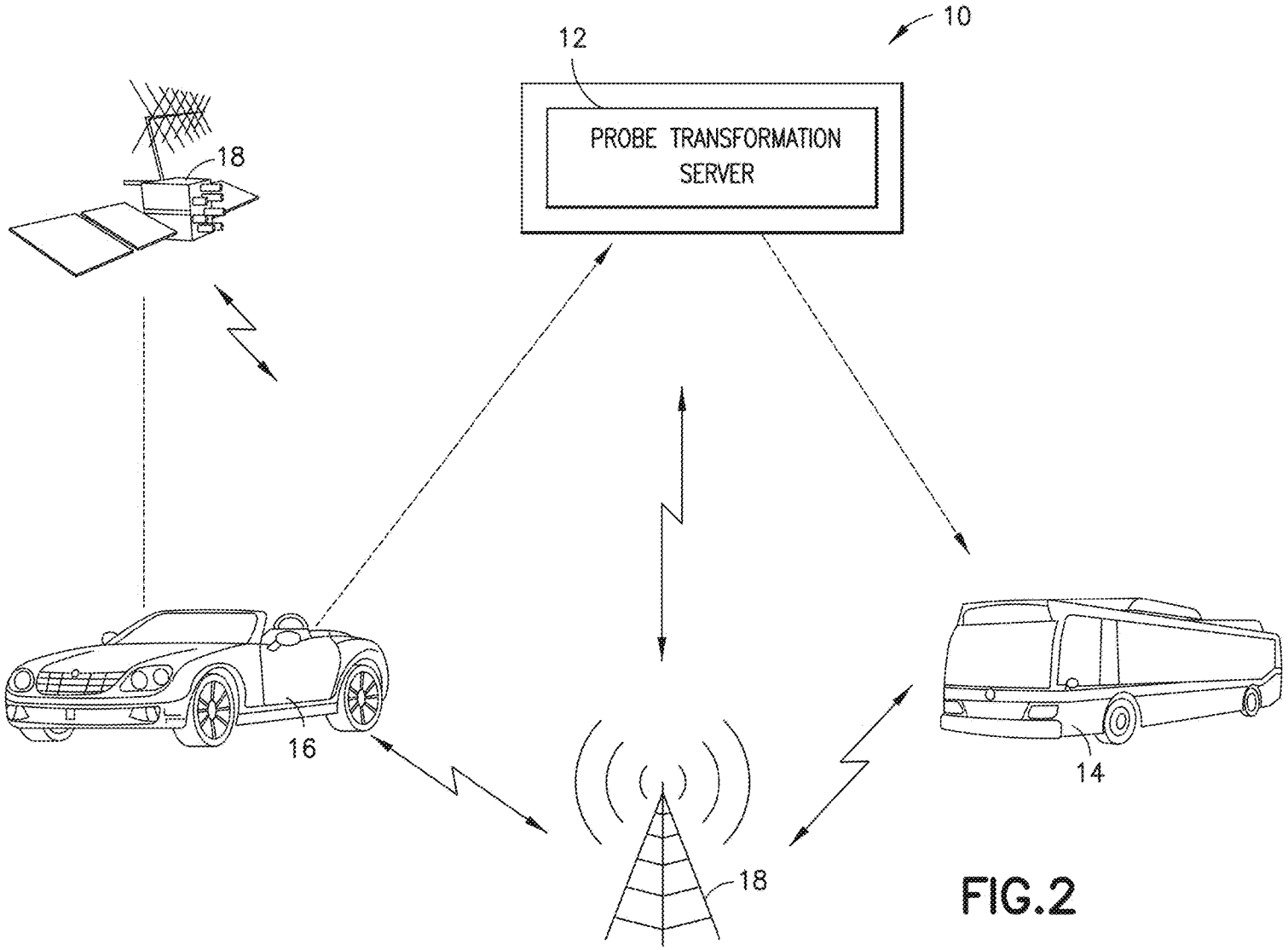
FIG. 2 illustrates another example of a traffic information system and probe transformation model incorporating features of the invention.

However, the various exemplary embodiments of the invention are not limited to converting only bus probe information. According to the various exemplary embodiments, methods to transform probe data obtained from one source into data representing another source are provided. For example, car probe data can be converted into bus (such as a public passenger bus, for example) probe data (as shown in FIG. 2). Or, in other embodiments car probe data can be converted to bike probe or passenger probe data. For another example, the system can convert probes of pedestrians to those of buses. Probe data can be in form of [vehicle id, latitude, longitude, speed, heading], for example. Additionally, the exemplary embodiments provide for converting probes of one transportation type such as that of cars to that of buses or vice versa.

As mentioned above, often times, travel time, traffic flow, and travel speed information is available for freeways and expressways. These can be derived from probe vehicles such as cars traversing these roads that reports information such as location changes, speed, etc. On the other hand, urban smaller streets are usually void or imprecise in terms of real time travel information such as travel time or traffic flow. This issue is due to the fact that the probes that usually provide location and travel information are mainly on major roadways such as expressways and freeways. On the other hand, on smaller urban smaller streets, regular probes do not generally exist [or exist in small numbers or inadequate coverage]. However, public passenger buses (such as mass transit busses, for example) exist and, according to various exemplary embodiments of the invention, public passenger buses can be used as probes, the probe transformation server can then derive car travel time, car travel speed, and car traffic flow on urban smaller streets. This would be a bus probe to car probe transformation for one example.

Figure 3:
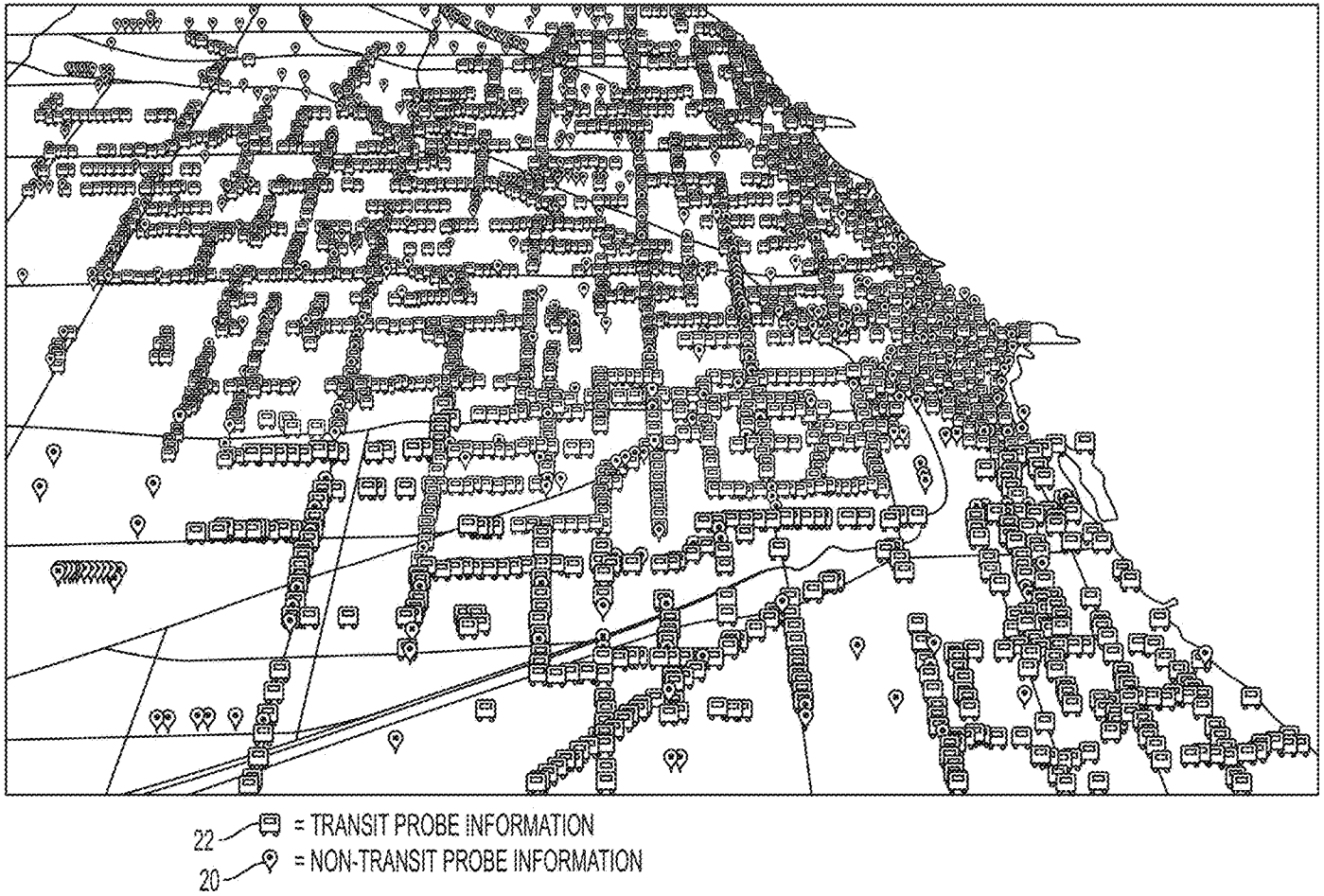
FIG. 3 is a representation of a city/urban area illustrating probes of the model shown in FIGS. 1, 2.

Referring now also to FIG. 3, there is shown a distribution of probes including non-transit probes 20 and transit probes 22 (as supplied by public passenger buses in a city) during a 5 minute epoch. This shows that on arterial streets there are generally not enough non-transit probes 20 and is therefore difficult to provide efficient traffic information on arterials. Thus, converting the transit probe information to non-transit probe information for use in traffic information extraction improves efficiency, since if we consider say public passenger buses provide greater coverage. Various exemplary embodiments of the invention provide for a method that takes as input probes of one transportation mode and outputs probes of say another transportation mode. Subsequently, in regions where there is a deficiency of one probe source or transportation mode, the available transportation mode can be automatically converted to the deficient.

Figure 4:
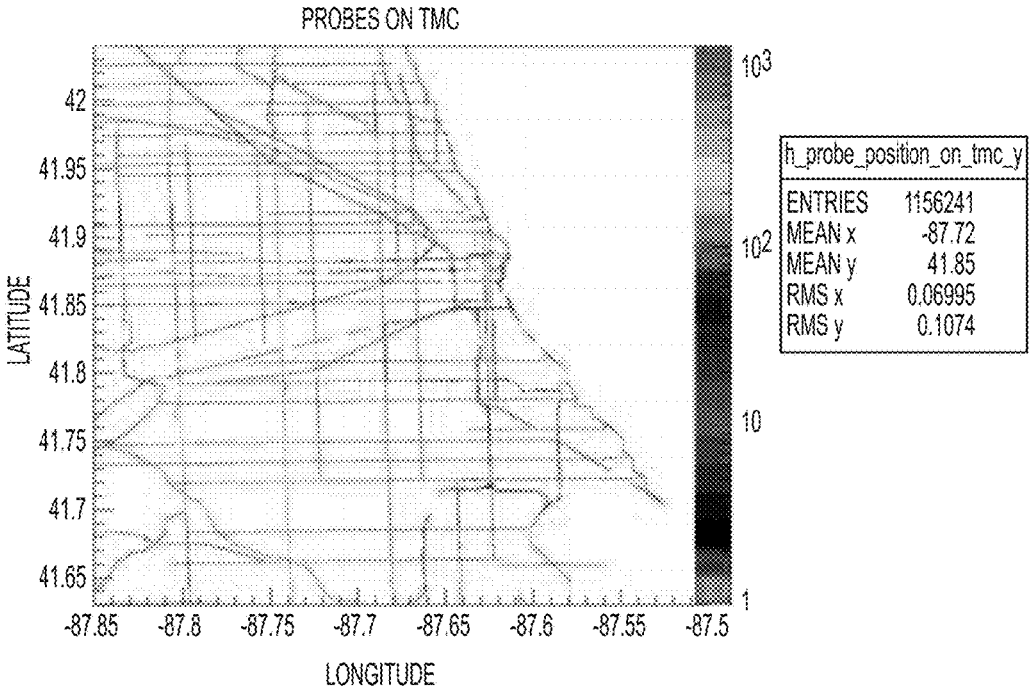
FIG. 4 is a representation including latitude and longitude illustrating transit probes of the model shown in FIGS. 1, 2.
Figure 5:
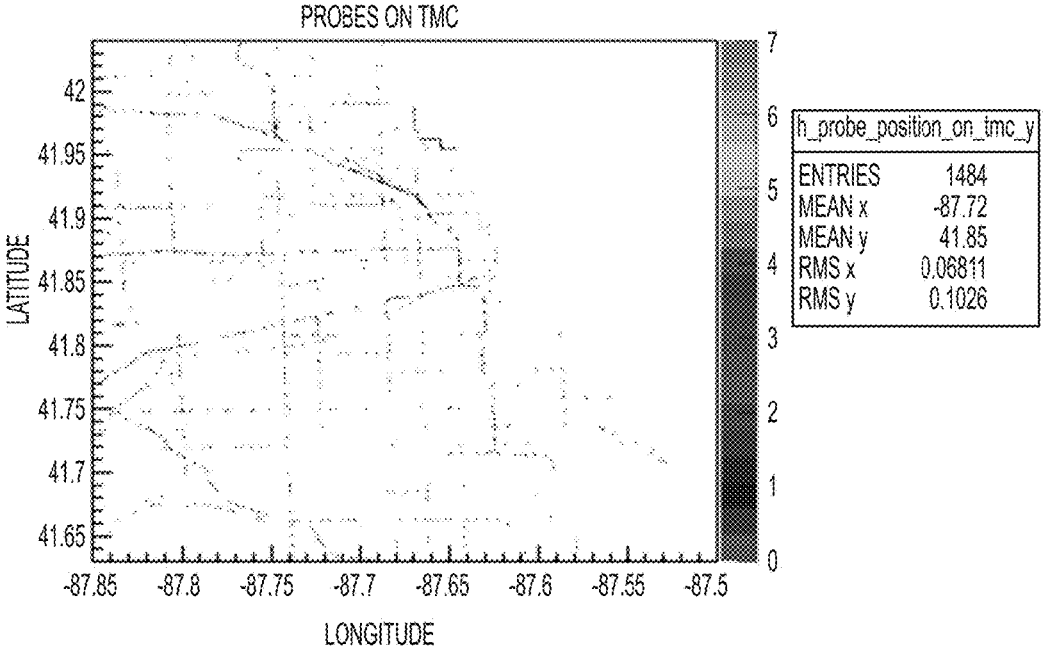
FIG. 5 is a representation including latitude and longitude illustrating non-transit probes of the model shown in FIGS. 1, 2.
Figure 6:
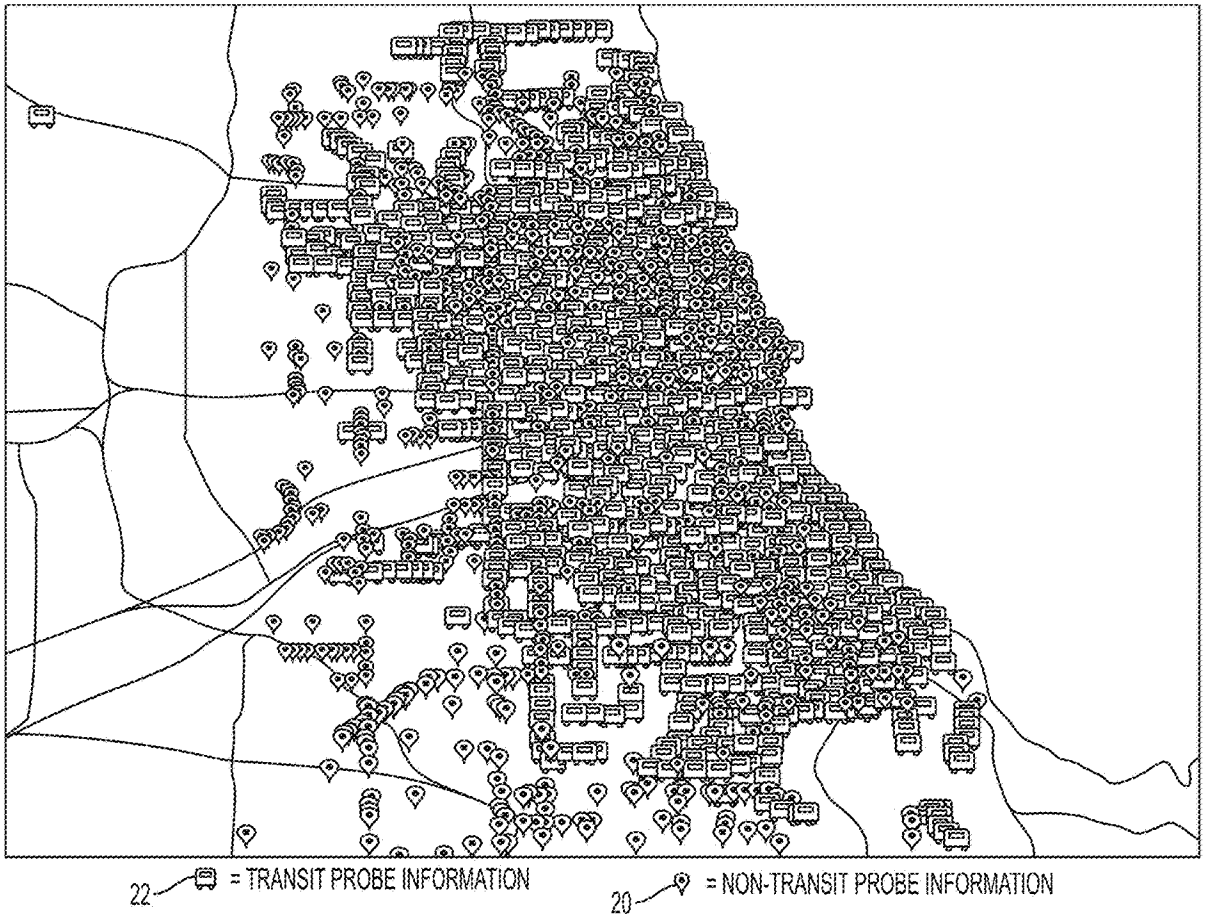
FIG. 6 is a representation of a city/urban area illustrating probes shown in FIGS. 4, 5.
Figure 7:
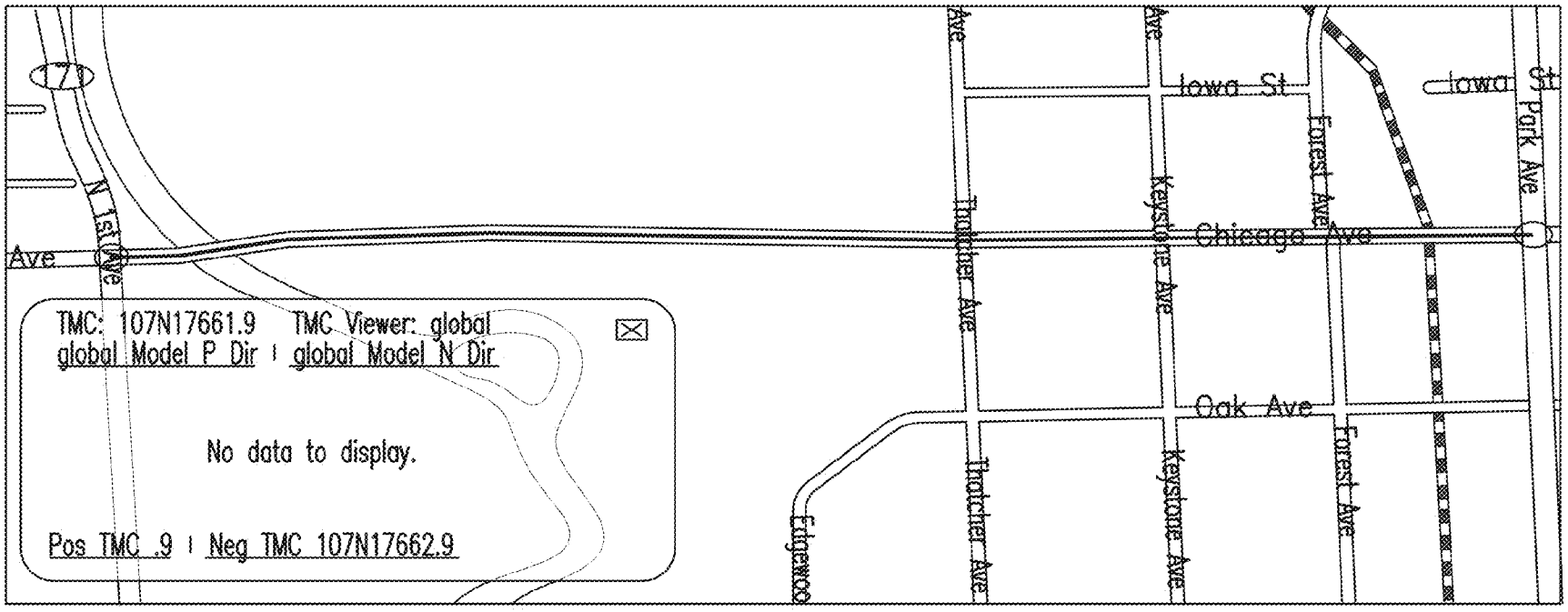
FIG. 7 is an illustration of a traffic message channel addressing scheme used in the model shown in FIGS. 1, 2.

Referring now also to FIGS. 4-6, there is shown a distribution of probes in an urban geographical location/area illustrating a snapshot of a distribution of probes in the urban geographical location/area. For example, in some situations there may be a substantial amount of probes from one transportation mode and limited amount of probes of another mode. In particular, FIGS. 4-6 show that the number of probes (for example, non-transit in this case) on expressways is large while within the city streets there are few probes. Thus, travel time estimation, traffic flow, and estimated travel speed on city streets is difficult. However, within the city, the public passenger (mass transit) buses operate daily, and the probe transformation server is configured to convert say the public passenger bus probe information to car probe information. This way car travel time, traffic flow, and travel speed can be ascertained from the buses probe information. According to some embodiments of the invention, an algorithm performed by the probe transformation server 12 would convert all the bus or transit probes to non-transit probes. This way, total probe coverage for the entire urban (city) geographical location/area would be provided. Additionally, as mentioned above, the various exemplary embodiments of the invention are not limited to only bus to car probe conversion, and in general, the probe transformation server can provide for probe conversion from one transportation mode to another.

In general, real-time road traffic information from traffic providers (such as Nokia, for example) is reported using a Traffic message channel (TMC) addressing scheme to map traffic conditions to road-segments. Traffic Message Channel (TMC) is a technology for delivering traffic and travel information to motor vehicle drivers. TMC allows silent delivery of dynamic information suitable for reproduction or display in the user's language without interrupting audio broadcast services. Each message generally includes an event code, location code [e.g. id], expected incident duration, affected extent and other details. It is to be noted that, according to various exemplary embodiments of the invention, a TMC is a segment of road and contains a global identification that is understood by traffic providers and consumers. For example, referring now to FIG. 7, there is shown an example of a TMC (or TMC encoded street segments), its identification, among other properties. In general, a TMC is about one to about two and a half miles long. In general, the TMC can cover several road links. In the example shown in FIG. 7, the ID of the TMC is 107N17661. Once traffic is reported on 107N17661, all traffic consumers are aware of the set of affected road segments.

The relationship of the probe data based on the probe transformation server 12 will be better understood following a description of an abundant probe (e.g., a probe type for which there are a substantial number of probes) and a deficient probe (e.g., a probe type for which there are a limited number of probes) concept. For example, referring to the abundant probe as 'type A' and the deficient probe as 'type B', the tendency is generally to transform the abundant probe type to the deficient probe type to increase probe coverage in a geographical area.

In general, there is preprocessing step where noises in the probes are removed. For instance, in the case of a bus probes to car probe conversion, buses stopping at bus stops contribute to the most noise in bus data. One way to mitigate this problem, the location of the bus stops are considered in the model and bus probes submitted say 0-25 m from the bus stop is suppressed and pruned from the system.

Figure 8:
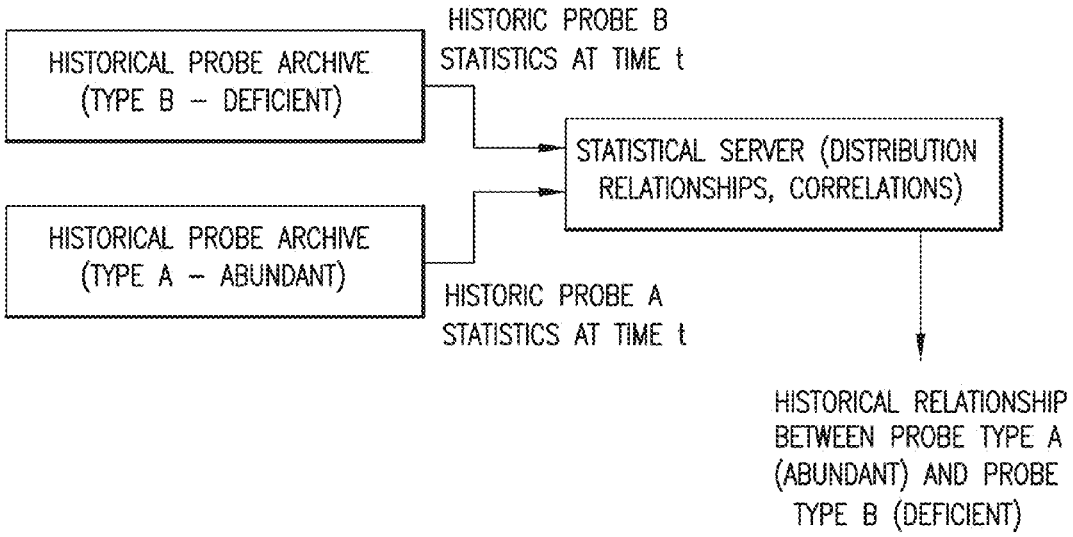
FIG. 8 is a block diagram illustrating a historical probe relationship used in the model shown in FIGS. 1, 2.

According to various exemplary embodiments, several historical relationships between the two probe types are first computed via a historical statistical server (see FIG. 8 illustrating a historical probe type A and probe type B relationship). These relationships can be, for example, at the city level, country level, TMC level or road link level or temporal intervals for each road link.

Figure 9:
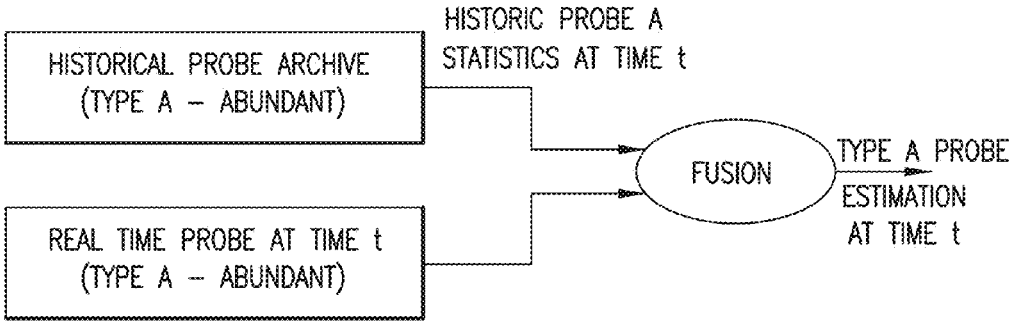
FIG. 9 is a block diagram illustrating an abundant probe real time prediction model used in the model shown in FIGS. 1, 2.
Figure 10:
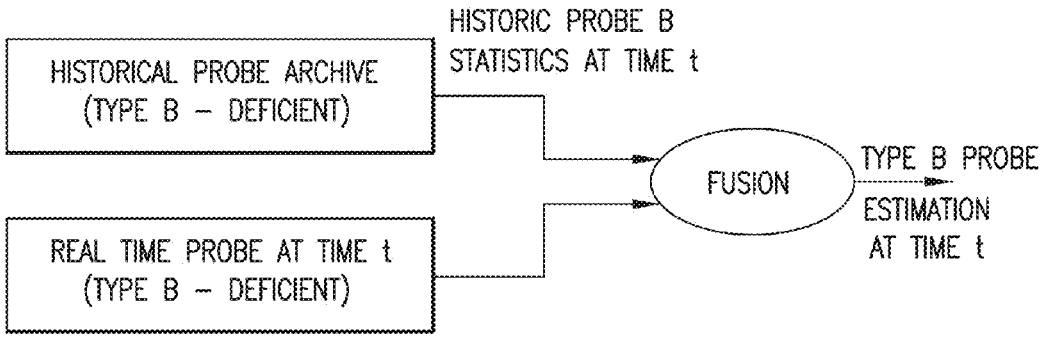
FIG. 10 is a block diagram illustrating a deficient probe real time prediction model used in the model shown in FIGS. 1, 2.
Figure 11:
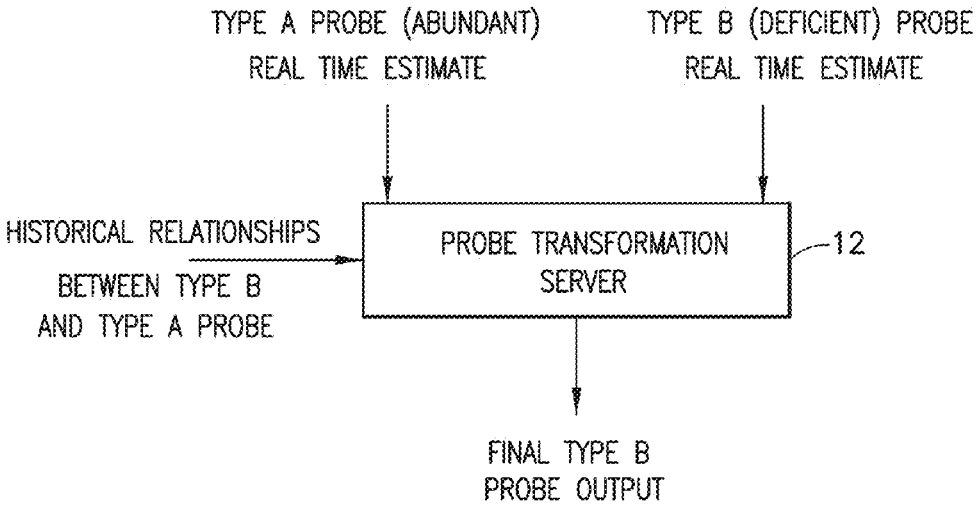
FIG. 11 is a block diagram illustrating the probe transformation model shown in FIGS. 1, 2.

Second, the current real time estimate of the abundant probes is predicted by merging real time and historical data on the abundant probe using a precomputed fitted weighted average scheme or a dynamic weighted (see FIG. 9 illustrating an abundant probe [type A] real time prediction model). Likewise, the current real time estimate of the deficient probes is constructed by merging the sparse and deficient real time and historical data (see FIG. 10 illustrating a deficient probe [type B] real time prediction model). Given, these two predictions (FIGS. 9 and 10) and the historical relationships (FIG. 8) as computed by the statistical server component, the probe transformation server then converts the abundant probes to the deficient probes (see FIG. 11 illustrating a generic probe transformation model).

It should be noted that the description of any particular order of the method above does not necessarily imply that there is a required or preferred order for the method and the order and arrangement of the method may be varied. Furthermore it may be possible for some portions of the method to be omitted.

Having observed a general description of the method above, attention may now be given to the different technical components of various exemplary embodiments of the invention.

Referring to FIG. 8 (illustrating the historical statistical server), there is shown the historical relationship subsystem which maintains historic statistical relationships about the candidate probes. This subsystem generally maintains relationships between the two probe types that there is an interest in converting between. For example, one probe type will be the input, while transforming the input will produce an output which is the other probe type.

The historic statistics that the server maintains can be distribution relationships between probe type A and probe type B. Additionally, correlation relationships are also maintained. Other relationships that exist between the two probe types are maintained on location, travel time and travel speed. Example relationships may be as follows:

$$\text{Probe Type } B \text{ location} = S + T^{*}\text{probe Type } A \text{ location}$$

$$\text{Probe Type } B \text{ travel time} = X + Y^{*}\text{probe Type } A \text{ travel time}$$

$$\text{Probe Type } B \text{ travel speed} = U + V^{*}\text{probe Type } A \text{ travel speed}$$

Specifically, for the bus probe to car probe case, these can be re-written as:

car location=$S+T$*bus location car travel time=$X+Y$*bus travel time car travel speed=$U+V$*bus travel speed Where U, V, S, T, X, and Y are constants or further equations. The relationship between the two sets of probes are stored with respect to the city, road link, time points and road links, time point and city, etcetera.

The statistical relationships between the deficient and abundant probe types can also be statistically related to maximum or minimum properties of the probe types. For example, relationships on maximum travel speed and time for the deficient and abundant probe sets. For another example, relationships on minimum travel speed and time for the abundant and deficient probe is also maintained. Example relationships may be as follows:

Probe Type $B$ travel time=$P$*(probe Type $A$ maximum travel time||probe Type $A$ minimum travel time)+−ERROR Probe Type $B$ travel speed=$Q$*(probe Type $A$ maximum travel speed||probe Type $A$ minimum travel speed)+−ERROR Where P and Q are constants or further statistical relationships.

The statistical relationships between the abundant and deficient probe sets can also be related specifically to the underlying road segment. Roads can be further classified according to different properties such as weather or congestion and then historical relationships computed. For example, if roads are categorized in levels according to congestion. Then given these different congestion categories, historical statistical relationships between the two probes sets (for example, the deficient type B and the abundant type A) are computed. For example, when there is heavy congestion the relationship could be probe B=probe A+ERROR, but when the congestion is light, the relationship can be probe B=probe A−ERROR.

Statistical correlations between the abundant probe types A and the deficient probe type B can also be captured in terms of relationships on mean, standard deviation, etcetera. Relationships can be linear, quadratic, polynomial, etcetera.

Figure 13:
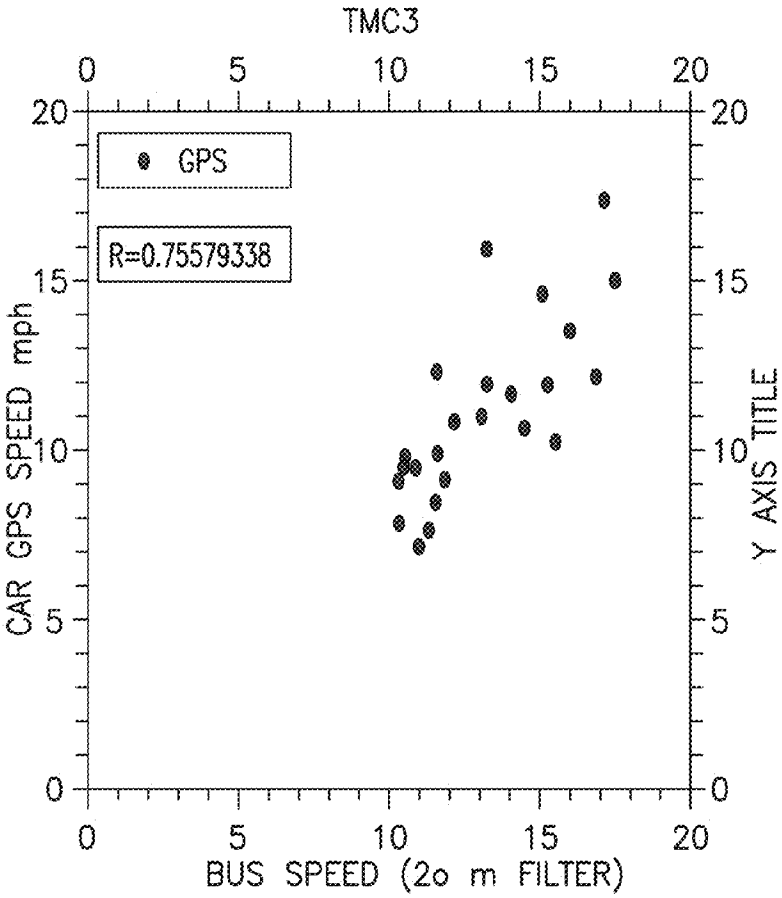
FIGS. 12-13 are scatter plots for transit and non-transit probes used in the model shown in FIGS. 1, 2.
Figure 12:
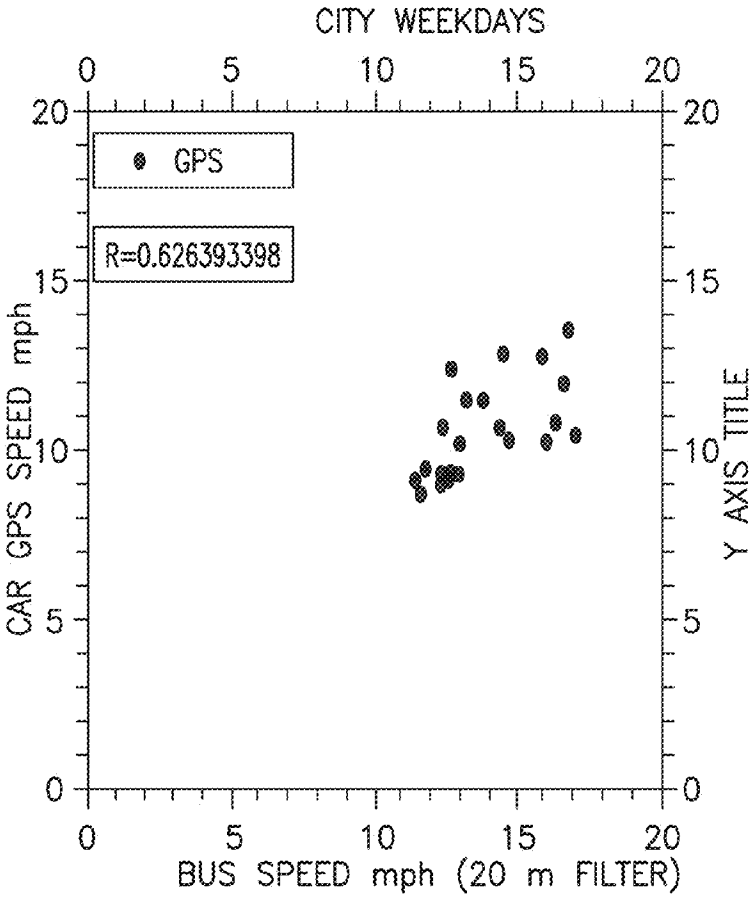

Referring now also to FIGS. 12, 13 there are shown scatter plots for bus probes and car probes for a city geographical area and for a single TMC. The plots show the relationship between bus probe speed and car probe speed. The correlation coefficient is 0.63 and 0.755 which indicate that a strong correlation exists.)

Figure 14:
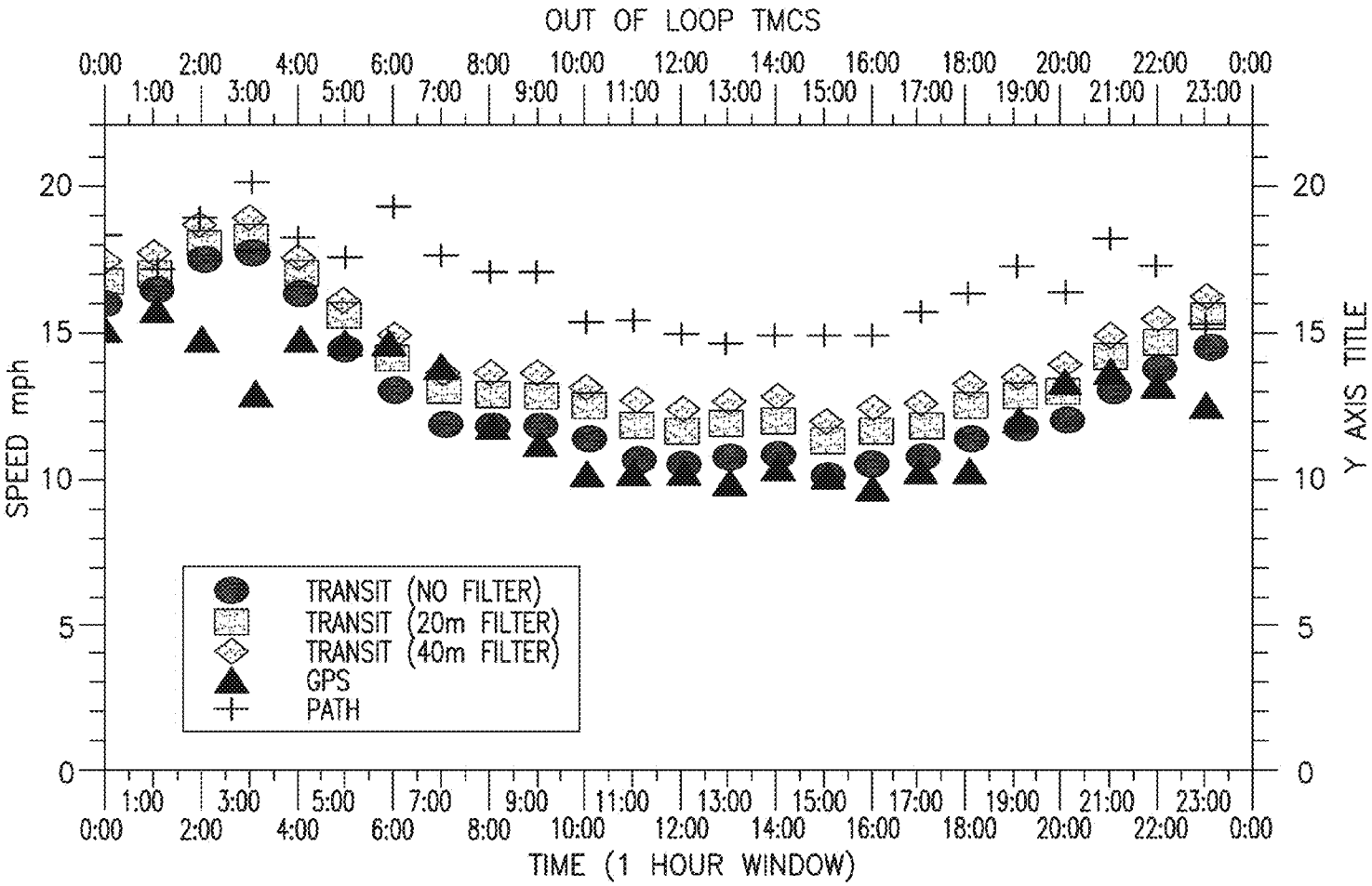
FIG. 14 is another scatter plot for transit and non-transit probes used in the model shown in FIGS. 1, 2.

Referring now also to FIG. 14, there is shown a scatter plot that shows the relationship between bus probe speed and car probe speed for a single road link during 1 hour time windows. GPS and Path is the GPS speed and path speed of the car while transit (no filter, 20 m filter, 40 m filter) is the speed of transits.

Referring to FIG. 10 there is shown a deficient probe (type B) real time estimation where a probe of one transportation mode can be transformed to probes representing another transportation mode. Generally, according to various exemplary embodiments of the invention, there can be provided a transformation from say an abundant transportation mode to a deficient transportation mode such as the bus probe to car probe transformation on urban city streets. This way city (mass transit) busses can be used to do high level attribute extraction for cars. These include say for example, car travel time and travel speed estimations from the abundant bus probes.

For the deficient probe, which is referred to as type B above, an accurate estimation or prediction given the current deficiency is generally desired. The deficiency is generally caused by low penetration ratio of the type B probes. In this stage of the prediction, two kinds of data obtained from the deficient probes can be considered. The two kinds of data are:

(1) Historical data on the deficient probe (2) Real time data on the deficient probe.

Even though the probe set can be deficient, and the real time probe reports can be generally sparse, the deficient historical data and sparse real time data is still data of the type B probe can be used effectively. These two data can be fused to produce an estimate of the deficient probe using data only on the deficient probe itself. In other words, the abundant probe type is not considered in this subsystem. Instead, using the deficient data only (both deficient historical and deficient real time) will be described as to how to combine them to provide an estimate.

The combination of historical data and real time can be a fitted weight weighted average scheme. Where:

deficient estimate=$A$*historical mean of deficient probe at time $t$+(1−$A$)*real time observations.

Where A is the fitted weight and 0<=A<=1. The best value of A can be precomputed apriori and utilized thereafter.

The combination of historical data and real time can be also dynamic according to the error of the deficient historical data and the deficient real time data. In this case, the combination is dynamic according to the two variances. For example, the computation in the presence of the variances may be as follows:

Let q(t) and Q(t) be the historic mean and historic variances of the deficient probe type B. Let the real time observation be y(t). Additionally, let mean and variance of the estimated observation variance be r(t) and R(t) respectively.

$$\text{Now, deficient probe estimate} = \frac{R(t)}{Q(t)+R(t)} \cdot \hat{q}(t) + \frac{Q(t)}{Q(t)+R(t)} \cdot (y(t) - r(t))$$

Referring to FIG. 9 there is shown an abundant probe (type A) real time estimation where real time estimation on abundant probes (for example, type A) at time t are provided. To do this, two types of data on the abundant probes can be considered. The two types of data are:

(1) Historical data on the abundant probe.

(2) Real time data on the abundant probe.

The estimation may be a fusion as in the case for the deficient probes. The fusion can be precomputed fitted weights or dynamic according to the size of the variances. For example:

Abundant estimate=$A$*historical mean of abundant probe at time $t$+(1−$A$)*real time observations.

The value of A can be within the range 0<=A<=1 in say atomic 0.1 increments.

$$\text{OR Abundant probe estimate} = \frac{R(t)}{Q(t)+R(t)} \cdot \hat{q}(t) + \frac{Q(t)}{Q(t)+R(t)} \cdot (y(t) - r(t))$$

where the definition of the variables are the same as in the deficient case, but with respect to the abundant probe data.

Referring to FIG. 11 there is shown Type A (abundant) to type B (deficient) probe transformation, where the main module engine combines all three above subsystems. As shown in FIG. 11, three inputs exists, these are outputs from the three above subsystems (for example, see FIGS. 8, 9, 10). The probe transformer 12 operates by first accepting real time estimates of the current abundant probes (type A, for example, bus) [see FIG. 9] and also real time estimates on the current deficient probe (type B, for example, car) [see FIG. 10]. Based on the historical relationships that is also an input to the probe transformer 12 and an output of FIG. 8, the probe transformer can then transform probes of type A (abundant) to probes of type B (deficient probe) based on the current estimates and known statistical relationships. For example, an illustration/depiction of example transformations is shown in FIGS. 1, 2.

In another example embodiment, only two inputs are needed. The two inputs can be (1) historic relationships, and (2) type A probe real time estimate. The output will be generally the same which is the type B probe output.

Referring to FIG. 1, illustrating an example probe transformation, the abundant probes are buses and these get transformed to probes representing cars. According to various exemplary embodiments of the invention, probes obtained from one transportation mode can be transformed to another transportation mode.

Figure 15:
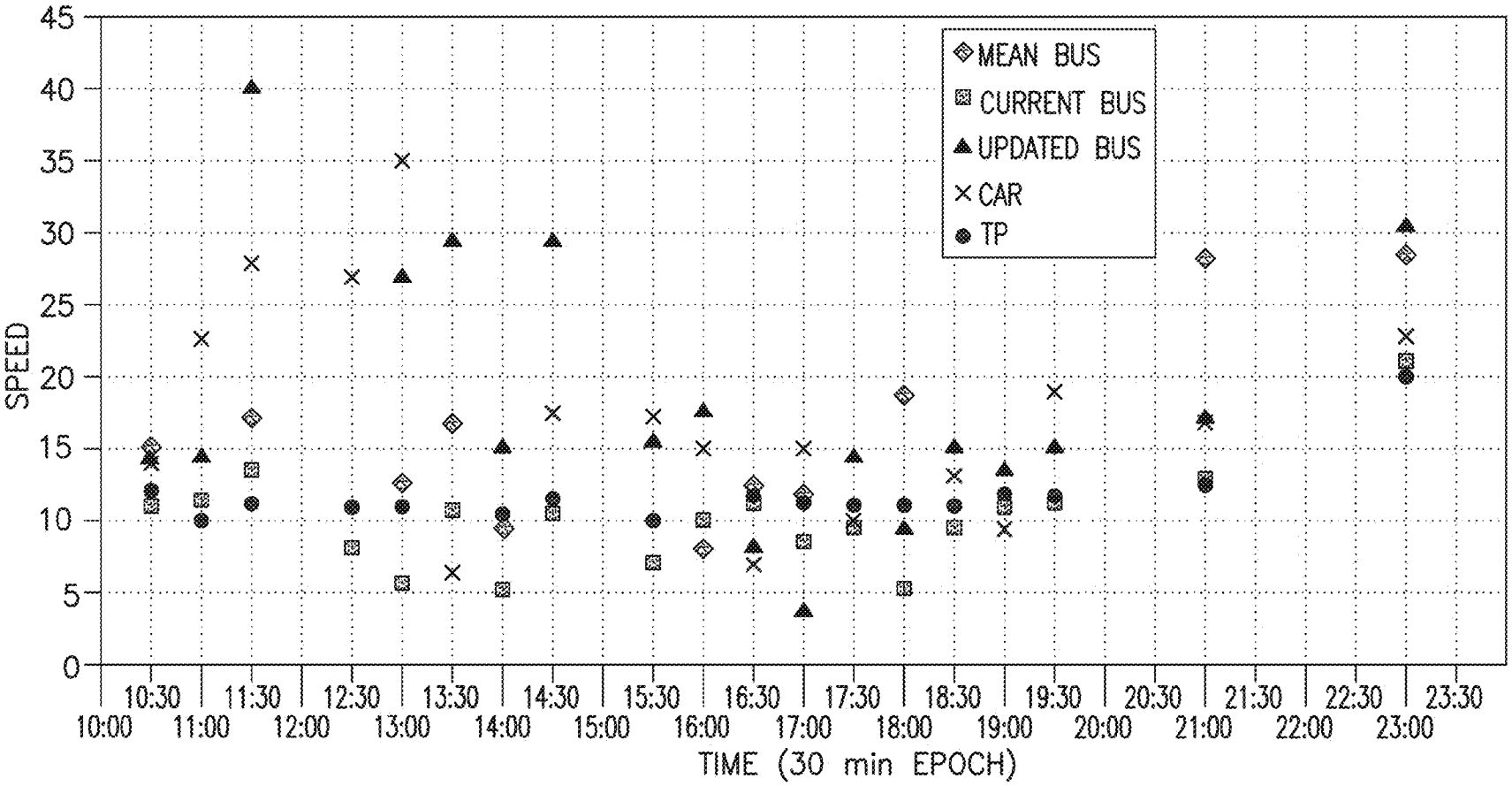
FIG. 15 illustrates experimental results of the model shown in FIGS. 1, 2.

Referring now to FIG. 15, there is depicted experimental results showing the updated bus speed by the algorithm (performed by the probe transformation server 12) is similar to the speed of cars. This generally illustrates that bus probes can be converted to non-bus or car probes effectively. It should be note that although FIG. 15 illustrates using bus to car conversion to prove the efficiency of the model, probe transformation across any suitable type of transportation mode(s) may be provided.

For example, with probes from one transportation mode or source, it can be converted to another probe source or transportation mode. For example, probes from pedestrians or say public passenger transit vehicles can be converted to those on non-transit vehicles such as cars. This provides, for example, for using pedestrian probes to produce car probes and thus use pedestrians to derive car travel time, car traffic flow, and car travel speed, etcetera. Additionally, as noted above, the various exemplary embodiments of the invention are not limited to bus to car probe conversion, and in alternate embodiments a generic model that transforms probe information across any transportation mode is provided.

Figure 16:
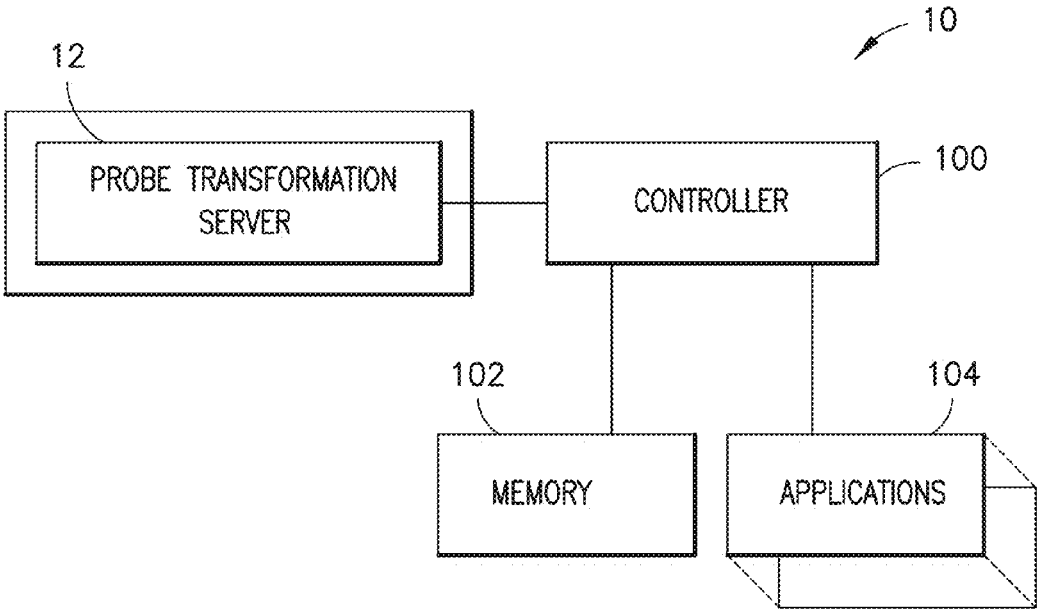
FIG. 16 is a schematic drawing illustrating components of the traffic information system shown in FIGS. 1, 2.

Referring now also to FIG. 16, the traffic information system 10 generally comprises a controller 100 such as a microprocessor for example. The electronic circuitry includes a memory 102 coupled to the controller 100, such as on a printed circuit board for example. The memory could include multiple memories including removable memory modules for example. The traffic information system 10 has applications 104, such as software, for example. The Probe Transformation Server 12 also is coupled to the controller 100.

Figure 17:
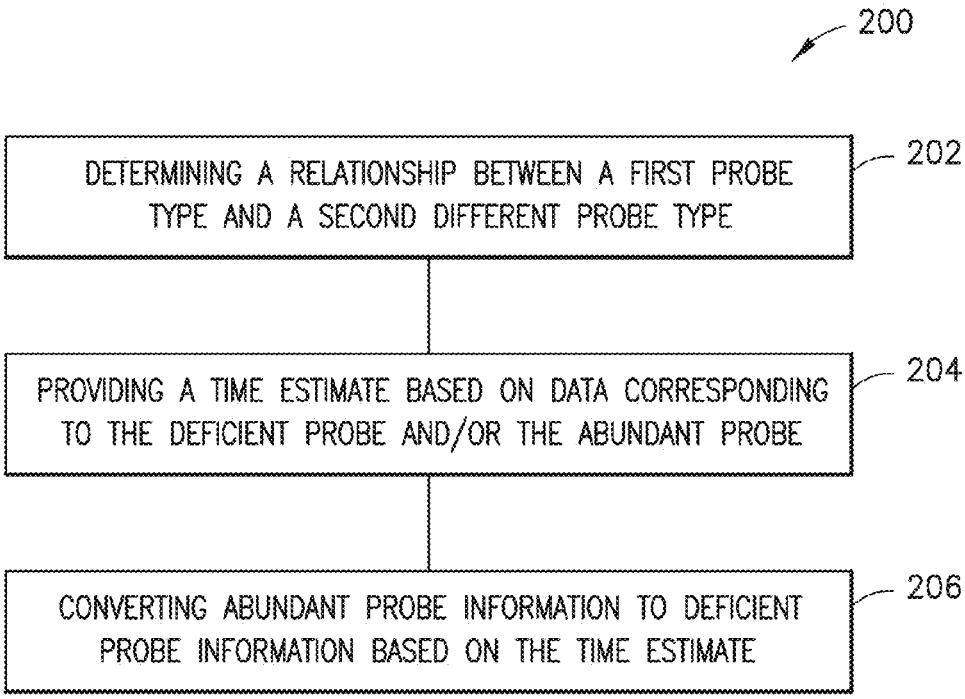
FIG. 17 is a block diagram of an exemplary method of the traffic information system shown in FIGS. 1, 2.

FIG. 17 illustrates a method 200. The method 200 includes determining a relationship between a first probe type and a second different probe type, wherein the first probe type comprises one of a deficient probe or an abundant probe, wherein the second different probe type comprises the other of the deficient probe or the abundant probe (at block 202). Providing a time estimate based on data corresponding to the deficient probe and/or the abundant probe (at block 204). Converting abundant probe information to deficient probe information based on the time estimate (at block 206). It should be noted that the illustration of a particular order of the blocks does not necessarily imply that there is a required or preferred order for the blocks and the order and arrangement of the blocks may be varied. Furthermore it may be possible for some blocks to be omitted.

Technical effects of any one or more of the exemplary embodiments provide improvements when compared to conventional configurations. Many of the conventional configurations concerning probe data is related to obtaining high level information and high order attributes such as travel time, traffic conditions, road geometries, incidents, traffic flow, and so forth, from the probe data. Whereas, according to various exemplary embodiments of the invention, a method for transforming probe data from one transportation mode to another transportation mode is provided, wherein probes of a given transportation mode can be provided to derive high order attributes such as travel speed, traffic flow, incidents, for another different transportation mode.

Without in any way limiting the scope, interpretation, or application of the claims appearing below, a technical effect of one or more of the example embodiments disclosed herein is a method of transforming probe data from one transportation mode to another transportation mode. Another technical effect of one or more of the example embodiments disclosed herein is a scheme to transform the probe data into probes mimicking a different transportation mode, given probe data obtained from candidate vehicles with a specific transportation mode. Another technical effect of one or more of the example embodiments disclosed herein is to transform probe data that is obtained from buses to probe data that would have come from cars, with systems and methods that transform probes across transportation modes, so that buses can be used produce car probes.

It should be understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Embodiments of the present invention may be implemented in software, hardware, application logic or a combination of software, hardware and application logic. The software, application logic and/or hardware may reside on the server, or any other suitable location. If desired, part of the software, application logic and/or hardware may reside on the server, and part of the software, application logic and/or hardware may reside on the other suitable location. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted in FIGS. 1, 2, 16. A computer-readable medium may comprise a computer-readable storage medium that may be any media or means that can contain or store the instructions for use by or in connection with an instruction execution system, apparatus, or device, such as a computer.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a method, comprising: determining a relationship between a first probe type and a second different probe type, wherein the first probe type comprises one of a deficient probe or an abundant probe, wherein the second different probe type comprises the other of the deficient probe or the abundant probe; providing a time estimate based on data corresponding to the deficient probe and/or the abundant probe; and converting abundant probe information to deficient probe information based on the time estimate.

A method as above, wherein the first probe type corresponds to a transit probe, and wherein the second probe type corresponds to a non-transit probe.

A method as above, wherein the first probe type corresponds to a transit bus, and wherein the second probe type corresponds to a train, car, bus, walk, run, or bike.

A method as above, further comprising determining an amount of abundant probes in a geographical area.

A method as above, further comprising determining an amount of deficient probes in the geographical area.

A method as above, further comprising determining a historical relationship between the first probe type and the second probe type.

A method as above, wherein the converting of the abundant probe information to deficient probe information is further based on a historical relationship between the first probe type and the second probe type, an abundant probe real time estimate, and a deficient probe real time estimate.

In another exemplary embodiment, an apparatus comprising: at least one processor; and at least one memory including computer program code, the at least one memory and the computer program code configured to, with the at least one processor, cause the apparatus to perform at least the following: receive a first information corresponding to a first transportation mode; and transform the first information into a second information based on a analysis of the first information, wherein the second information corresponds to a second different transportation mode.

An apparatus as above, wherein the first transportation mode corresponds to a transit mode, and wherein the second transportation mode corresponds to a non-transit mode.

An apparatus as above, wherein the first transportation mode corresponds to a bus, and wherein the second transportation mode corresponds to a train, car, bus, walk, run, or bike.

An apparatus as above, wherein the apparatus further comprises a historical relationship subsystem.

An apparatus as above, wherein the first information corresponds to a first probe, wherein the second information corresponds to a second probe, and wherein the historical relationship subsystem is configured to maintain distribution relationships between the first probe and the second probe.

An apparatus as above, wherein the at least one memory and the computer program code configured to, with the at least one processor, cause the apparatus to transform the first information into a second information based on a historical relationship between a first probe type and a second probe type, an abundant probe real time estimate, and a deficient probe real time estimate.

An apparatus as above, wherein the apparatus comprises a probe transformation server.

In another exemplary embodiment, a computer program product comprising a computer-readable medium bearing computer program code embodied therein for use with a computer, the computer program code comprising: code for determining a relationship between a first information and a second information, wherein the first information corresponds to a first transportation mode, and wherein the second information corresponds to a second different transportation mode; and code for transforming the first information into a second information based on a analysis of the first information.

A computer program product as above wherein the first transportation mode corresponds to a transit mode, and wherein the second transportation mode corresponds to a non-transit mode.

A computer program product as above wherein the first transportation mode corresponds to a bus, and wherein the second transportation mode corresponds to a train, car, bus, walk, run, or bike.

A computer program product as above wherein the first information corresponds to a first probe, wherein the second information corresponds to a second probe, and wherein a historical relationship subsystem is configured to maintain distribution relationships between the first probe and the second probe.

A computer program product as above wherein the first probe and/or the second probe corresponds to a probe vehicle of a traffic information system.

A computer program product as above further comprising code for transforming the first information into a second information based on a historical relationship between a first probe type and a second probe type, an abundant probe real time estimate, and a deficient probe real time estimate.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims. It should further be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A method, comprising:

determining a historical or statistical relationship between a first probe type and a second different probe type, wherein the first probe type comprises an abundant probe of a first transportation mode, wherein the second different probe type comprises a deficient probe of a second different transportation mode;

providing a real time probe information estimate based on collected probe data corresponding to the abundant probe, wherein the real time probe information estimate relates to a location, travel time or speed of the abundant probe, wherein the probe data corresponding to the abundant probe is received from a plurality of probe data collection devices, each probe data collection device being installed onboard a vehicle corresponding to the first transportation mode, and wherein each probe data collection device is configured to provide at least one of latitude, longitude, speed, or heading of the corresponding vehicle; and converting, with a probe transformation server, probe information corresponding to the abundant probe type to probe information corresponding to the deficient probe by using the determined relationship and based on at least the real time probe information estimate, in order to estimate a location, travel time, or speed for the transportation mode corresponding to the deficient probe type; wherein:

when the abundant probe type is a transit bus transportation mode, the method further comprises:

identifying bus specific probe data; and prior to providing the real time probe information estimate, suppressing the bus specific probe data collected by a probe data collection device onboard a transit bus in order to remove noise in the probe data, wherein the bus specific probe data comprises (a) probe data collected by the probe data collection device onboard the transit bus when the transit bus is located within a threshold distance of a bus stop and (b) probe data collected by the probe data collection device onboard the transit bus when the transit bus is in a bus only lane, the threshold distance being a predetermined distance, and wherein the bus specific probe data is identified based on archived bus stop and bus only lane data accessible to the probe transformation server.

2. The method of claim 1 wherein the first probe type corresponds to a transit probe, and wherein the second probe type corresponds to a non-transit probe.

3. The method of claim 1 wherein the first probe type corresponds to a transit bus transportation mode, and wherein the second probe type corresponds to a car or truck transportation mode.

4. The method of claim 1 further comprising determining a number of abundant probes in a geographical area.

5. The method of claim 1 further comprising determining a number of deficient probes in a geographical area.

6. The method of claim 1 wherein the determining of the relationship comprises determining a historical relationship between the first probe type and the second probe type.

7. The method of claim 1 wherein the converting of the abundant probe information to deficient probe information is further based on a historical relationship between the first probe type and the second probe type, an abundant probe real time probe information estimate, and a deficient probe real time probe information estimate.

8. An apparatus, comprising:

at least one processor; and at least one memory including computer program code;

the at least one memory and the computer program code configured to, with the at least one processor, cause the apparatus to perform at least the following:

determine a historical or statistical relationship between a first probe type and a second different probe type, wherein the first probe type comprises an abundant probe of a first transportation mode, wherein the second different probe type comprises a deficient probe of a second different transportation mode;

provide a real time probe information estimate based on collected probe data corresponding to the abundant probe, wherein the real time probe information estimate relates to a location, travel time or speed of the abundant probe, wherein the probe data corresponding to the abundant probe is received from a plurality of probe data collection devices, each probe data collection device being installed onboard a vehicle corresponding to the first transportation mode, and wherein each probe data collection device is configured to provide at least one of latitude, longitude, speed, or heading of the corresponding vehicle; and convert, with a probe transformation server, probe information corresponding to the abundant probe type to probe information corresponding to the deficient probe by using the determined relationship and based on at least the real time probe information estimate, in order to estimate a location, travel time, or speed for the transportation mode corresponding to the deficient probe type; wherein:

when the abundant probe type is a transit bus transportation mode, the at least one memory and the computer program code are further configured to, with the at least one processor, cause the apparatus to perform at least the following:

identify bus specific probe data; and prior to providing the real time probe information estimate, suppress the bus specific probe data collected by a probe data collection device onboard a transit bus in order to remove noise in the probe data, wherein the bus specific probe data comprises (a) probe data collected by the probe data collection device onboard the transit bus when the transit bus is located within a threshold distance of a bus stop and (b) probe data collected by the probe data collection device onboard the transit bus when the transit bus is in a bus only lane, the threshold distance being a predetermined distance, and wherein the bus specific probe data is identified based on archived bus stop and bus only lane data accessible to the probe transformation server.

9. The apparatus of claim 8 wherein the first transportation mode corresponds to a transit mode, and wherein the second transportation mode corresponds to a non-transit mode.

10. The apparatus of claim 8 wherein the first transportation mode corresponds to a transit bus, and wherein the second transportation mode corresponds to a car or truck transportation mode.

11. The apparatus of claim 8 wherein the apparatus further comprises a historical relationship subsystem for determining the historical relationship between the first probe type and the second probe type.

12. The apparatus of claim 11 wherein the historical relationship subsystem is configured to store historical relationships between the first transportation mode and the second transportation mode in the at least one memory.

13. The apparatus of claim 8 wherein the at least one memory and the computer program code are configured to, with the at least one processor, cause the apparatus to convert the information based on a historical relationship between a first transportation mode and a second transportation mode, an abundant probe real time probe information estimate, and a deficient probe real time probe information estimate.

14. The apparatus of claim 8 wherein the second different transportation mode is a road vehicle transportation mode.

15. A computer program product comprising a non-transitory computer-readable medium bearing computer program code embodied therein for use with a computer, the computer program code comprising:

code for determining a historical or statistical relationship between a first probe type and a second different probe type, wherein the first probe type comprises an abundant probe of a first transportation mode, wherein the second different probe type comprises a deficient probe of a second different transportation mode;

code for providing a real time probe information estimate based on collected probe data corresponding to the abundant probe, wherein the real time probe information estimate relates to a location, travel time or speed of the abundant probe, wherein the probe data corresponding to the abundant probe is received from a plurality of probe data collection devices, each probe data collection device being installed onboard a vehicle corresponding to the first transportation mode, and wherein each probe data collection device is configured to provide at least one of latitude, longitude, speed, or heading of the corresponding vehicle;

code for converting, with a probe transformation server, probe information corresponding to the abundant probe type to probe information corresponding to the deficient probe by using the determined relationship and based on at least the real time probe information estimate, in order to estimate a location, travel time, or speed for the transportation mode corresponding to the deficient probe type; and code for when the abundant probe type is a transit bus transportation mode, identifying bus specific probe data, and, prior to providing the real time probe information estimate, suppressing the bus specific probe data collected by a probe data collection device onboard a transit bus in order to remove noise in the probe data, wherein the bus specific probe data comprises (a) probe data collected by the probe data collection device onboard the transit bus when the transit bus is located within a threshold distance of a bus stop and (b) probe data collected by the probe data collection device onboard the transit bus when the transit bus is in a bus only lane, the threshold distance being a predetermined distance, and wherein the bus specific probe data is identified based on archived bus stop and bus only lane data accessible to the probe transformation server.

16. The computer program product of claim 15 wherein the first transportation mode corresponds to a transit mode, and wherein the second transportation mode corresponds to a non-transit mode.

17. The computer program product of claim 15 wherein the first transportation mode corresponds to a transit bus transportation mode, and wherein the second transportation mode corresponds to a car or truck transportation mode.

18. The computer program product of claim 15 wherein a historical relationship subsystem is configured to store historical relationships between the first transportation mode and the second transportation mode.

19. The computer program product of claim 18 wherein the first probe type and/or the second probe type corresponds to a probe vehicle of a traffic information system.

20. The computer program product of claim 15 further comprising code for converting the information based on a historical relationship between a first transportation mode and a second transportation mode, an abundant probe real time probe information estimate, and a deficient probe real time probe information estimate.

* * * * *